US005598608A

United States Patent [19]

Naslund

[11] Patent Number: 5,598,608

[45] Date of Patent: Feb. 4, 1997

[54] CLIP, PARTICULARLY A BAG CLIP

[76] Inventor: Ingemar Naslund, Vassvagen 21, S-141 39 Huddinge, Sweden

[21] Appl. No.: 256,017

[22] PCT Filed: Jan. 21, 1993

[86] PCT No.: PCT/SE93/00035

§ 371 Date: Jun. 21, 1994

§ 102(e) Date: Jun. 21, 1994

[87] PCT Pub. No.: WO93/16930

PCT Pub. Date: Sep. 2, 1993

[30] Foreign Application Priority Data

Feb. 20, 1992 [SE] Sweden ..... 9200517

[51] Int. Cl.[6] ..... B65D 77/10; B65D 63/00; A44B 21/00

[52] U.S. Cl. ..... 24/30.5 R; 24/30.5 P; 24/543

[58] Field of Search ..... 24/30.5 R, 30.5 MP, 24/543, 30.5 P, 559–561, 564, 487

[56] References Cited

U.S. PATENT DOCUMENTS

| | | | |
|---|---|---|---|
| D. 190,787 | 6/1961 | Schneider | 24/30.5 P |
| 466,301 | 12/1891 | Green | 24/30.5 R |
| 1,412,813 | 4/1922 | Aves | 24/543 |
| 1,459,382 | 6/1923 | Wagner | 24/543 |
| 1,488,594 | 4/1924 | Gaschke | 24/543 |
| 1,505,461 | 10/1921 | Guyot et al. | 24/543 |
| 3,673,640 | 7/1972 | Brown | 24/30.5 R |
| 3,805,813 | 4/1974 | Laughton | 132/279 |
| 3,900,989 | 8/1975 | Weisenthal | 24/30.5 R X |
| 3,978,555 | 9/1976 | Weisenthal | 24/543 |
| 4,356,599 | 11/1982 | Larson et al. | 24/543 X |
| 4,514,885 | 5/1985 | Delahousse et al. | 24/543 X |
| 4,551,888 | 11/1985 | Beecher | 24/30.5 P |
| 4,656,697 | 4/1987 | Naslund | 24/30.5 P |
| 4,663,807 | 5/1987 | Bozzo | 24/30.5 P X |
| 4,847,956 | 7/1989 | Levine | 24/30.5 R |
| 4,923,153 | 5/1990 | Matsui et al. | 24/30.5 P X |
| 5,125,133 | 6/1992 | Morrison | 24/30.5 R |

*Primary Examiner*—Peter M. Cuomo
*Assistant Examiner*—Robert J. Sandy
*Attorney, Agent, or Firm*—Larson and Taylor

[57] ABSTRACT

A one-piece plastic clip, particularly for sealing bags at any location along the height of the bag or at a location adjacent the bag opening. The clip includes two mutually hinged limbs (2, 3) provided with bag engagement surfaces. The bag engagement surfaces are intended to engage bag material located therebetween, when the limbs are brought together so as to seal the bag. The free ends of the limbs are provided with a snaplock arrangement (4, 5) which can be opened manually and which locks automatically when the limbs are brought together. At least one (3) of the limbs has an elastically resilient bridge (6) which functions to press bag material sealingly against the opposing bag engagement surface, so as to seal the bag.

6 Claims, 2 Drawing Sheets

CLIP, PARTICULARLY A BAG CLIP

The present invention relates to a bag clip and then particularly to a bag clip which is intended for tightly sealing plastic bags at any location along the height of the bag or at a location adjacent the bag opening. The clip is a single piece structure which comprises two limbs or bars which are pivotally joined together at respective one ends thereof and which have bag-engaging surfaces which are intended to receive therebetween that portion of the bag where a seal is to be effected when the limbs are moved together with said bag portion located therebetween. The other ends of the limbs have a manually openable snaplock which closes automatically when the limbs are brought together.

A bag clip of this kind is known from the publication EP-A-O 156 779. Although this clip functions exceedingly well for the purpose for which it is intended, the construction of the clip is, nevertheless, relatively complicated, therewith rendering the moulding tool or pressing tool used to manufacture the clip relatively expensive. Furthermore, because of its complicated construction, the clip cannot be manufactured in comparatively small sizes, for reasons of a technical nature. The object of the present invention is to provide a clip of less complicated construction, so that the clip can be manufactured, as by injection moulding or extrusion processes, in a less expensive manner and in smaller dimensions than can the known clips, while maintaining material consumption at a relatively low level.

Also known to the art is a bag sealing clip as described in U.S. Pat. No. 4,847,956. This known clip comprises two limbs which are hinged together at one end thereof, so as to clamp tight on the open end of a flexible bag. The other ends of the limbs are held together by a multi-step latch and the clip is able to accommodate bag materials of different thicknesses as a result of an expandable hinge structure. This clip structure, however, is highly complicated and lies outside the general purview of the invention.

For the sake of completeness, reference can also be made to U.S. Pat. No. 3,805,813, which teaches an automatic hair clasp. This hair clasp, however, has little resemblance to the inventive bag clip.

The novel, characteristic features of the inventive clip are set forth hereafter.

The invention will now be described in more detail with reference to an exemplifying embodiment of an inventive bag clip and also with reference to the accompany schematic drawings, in which FIG. 1 is a perspective view of a preferred embodiment of an inventive clip, showing the clip in its open position;

Figure 1:
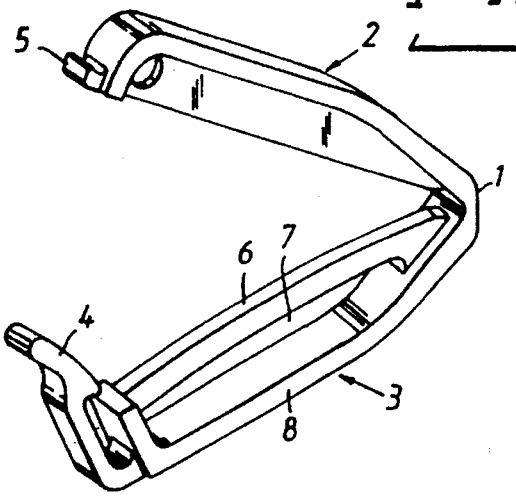
Figure 2:
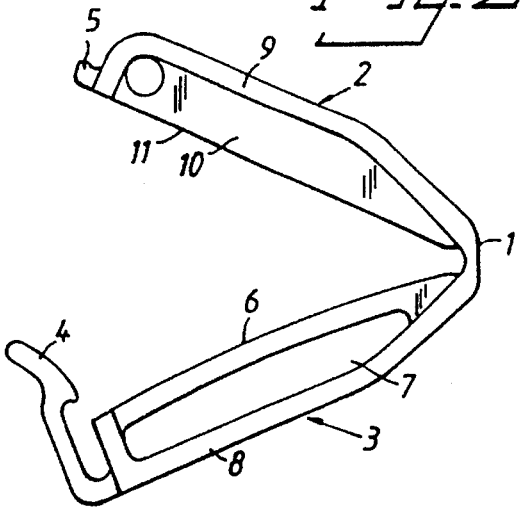
FIG. 2 is a side view of the clip shown in FIG. 1.
Figure 3:
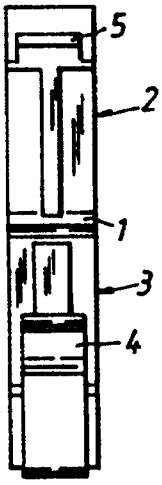
FIG. 3 is a front view of the clip shown in FIG. 1 and in FIG. 2.
Figure 4:
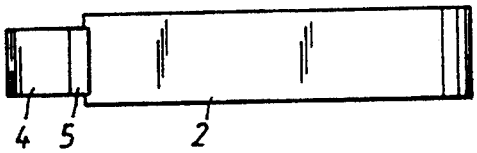
FIG. 4 shows the clip of FIG. 1 from above.

The clip is a one-piece structure made of a plastic material of suitable resiliency or elasticity and produced in accordance with a known process, such as injection moulding, plastic moulding or pressure moulding or extrusion processes, with the extruded profiled strand being sawn or otherwise divided into individual clips. The illustrated clip is comprised of two limbs 2 and 3 which are hinged together by a weakening fold 1. Provided at the free ends of the limbs

2 and 3 is a snaplock arrangement comprising a locking tongue 4 which forms part of the limb 3 and a shoulder or ledge 5 which projects outwardly from the limb 2. Located centrally of the limb 3, in the direction of its longitudinal axis, is an outwardly extending bridge 6 which is spaced from the bottom or base 8 of the limb, so as to define a space 7. The bridge 6 is curved slightly convexly in towards the space between the limbs. The other limb 2 has a central ridge 10 which projects out from the back 9 of said limb, the flat engagement surface 11 of said ridge being intended to clamp bag material between itself and the convex bridge engagement surface when the limbs are brought together.

Figure 5:
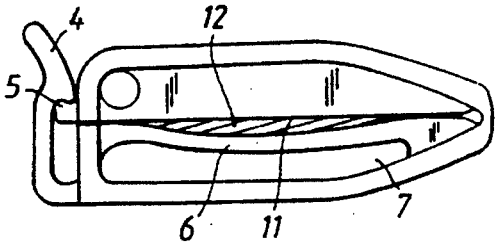
FIG. 5 shows the clip when closed, with bag material clamped between the limbs of the clip.
Figure 6:
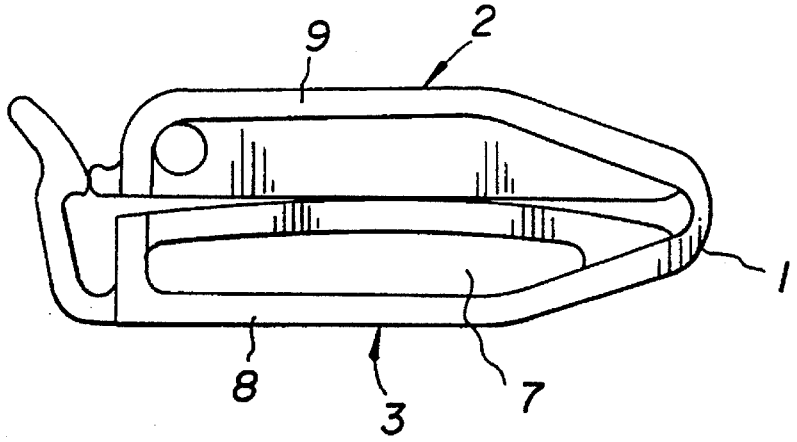
FIG. 6 is side view of the clip shown in FIG. 1 as it closes with no bag material between the limbs.

FIG. 5 shows the inventive clip with the two limbs 2 and 3 in a closed, locking position with bag material, for instance a plastic bag 12, clamped between the surface 11 of the limb 2 and the elastically resilient bridge 6. It will be seen from a comparison of FIG. 6 showing bag engagement surface 11 as it first contacts a center part of the engagement surface of bridge 6 (with no bag 12 therebetween FIG. 5 where the bag 12 is secured between the engagement surfaces that the bridge 6 has been bent concavely down towards the space or gap 7 by clamping action, thereby amplifying the clamping action produced commonly by the bridge 6 and the ridge 10, therewith also allowing non-elastic material to be firmly clamped.

The inventive clip can be used effectively with narrow bags whose widths do not exceed the width of the clip, and also with wider bags with which the bag material must be gathered or twisted together before the clip can be applied. The clip is also able to hold together paper, film, etc. without marking the paper or film as, for instance, is usual when paper clips are used. The clips can also be used to hold together cables and other elastic and inelastic materials.

Figure 7:
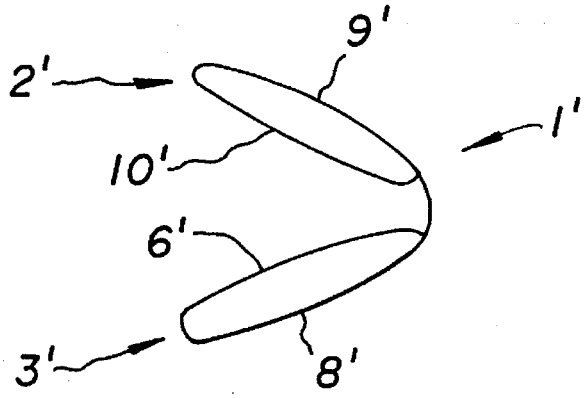
FIG. 7 is a side schematic view of an alternate embodiment of a clip in the open position.

FIG. 7 depicts a clip similar to that of FIGS. 1–6, but with a limb 2' having a second bridge 10' with engagement surface 11' similar to bridge 6 in place of ridge 10.

I claim:

1. A plastic clip for sealing a bag at a location along a height of the bag, said clip being made of a plastics material and as a single piece structure and comprising:

a first limb and a second limb, each said limb having a hinged end, said hinged ends being mutually hinged together such that said first and second limbs are hinged together, a free end opposite to said hinged end, and an engagement surface provided between the hinged end and free end, said engagement surfaces being opposite one another and being selectively brought together by hinged movement of said first and second limbs to trap a part of the bag between said engagement surfaces to seal the bag;

a manually openable and automatically closeable snaplock arrangement at the free ends of said first and second limbs by which the free ends are selectively (a) held together to maintain the part of the bag between said engagement surfaces or (b) opened to release the part of the bag from between said engagement surfaces or to permit insertion of the part of the bag between said engagement surfaces; and at least one of said first and second limbs including (a) a base extending between and being integrally attached to the respective hinge end and free end thereof and (b) an elastically resilient bridge also extending between and being integrally attached to the respective hinge end and free end thereof and spaced by an opening from said base with said bridge including said engagement surface of the at least one of said first and second limbs such that said resilient bridge is resiliently deformed when the part of the bag is sealed and said free ends are held together.

2. A plastic clip as claimed in claim 1 wherein said engagement surface included on said bridge has a slight arcuate, convex configuration.

3. A plastic clip as claimed in claim 1 wherein said snaplock arrangement includes a locking tongue provided on the at least one of said first and second limbs and a ledge on the other of said first and second limbs.

4. A plastic clip as claimed in claim 1 wherein said engagement surface included on said bridge includes a central portion which is designed to be contacted initially by said engagement surface of the other of said first and second limbs as said engagement surfaces are initially brought together with no part of the bag therebetween, and subsequently after initial contact of said central portion said engagement surface of the other of said first and second limbs contacts a remainder of said engagement surface of the at least one of said first and second limbs as said engagement surfaces are further brought together with no part of the bag therebetween.

5. A plastic clip as claimed in claim 3 wherein the resilient deformation of said resilient bridge when the part of the bag is sealed produces a counterpressure causing said locking tongue to be pressed against said ledge.

6. A plastic clip as claimed in claim 3 wherein the other of said at least one of said first and second limbs includes (a) a second base extending between and being integrally attached to the respective hinge end and free end thereof and (b) a second elastically resilient bridge also extending between and being integrally attached to the respective hinge end and free end thereof with said second bridge including the engagement surface of the other of said at least one of said first and second limbs.

* * * * *